United States Patent [19]

Geurtsen

[11] Patent Number: 4,463,830

[45] Date of Patent: Aug. 7, 1984

[54] REEL FOR A LIFE-LINE

[75] Inventor: Alfonsus A. Geurtsen, Deventer, Netherlands

[73] Assignee: Machinefabriek Geurtsen Deventer B.V., Deventer, Netherlands

[21] Appl. No.: 356,448

[22] Filed: Mar. 9, 1982

[30] Foreign Application Priority Data

Feb. 16, 1982 [EP] European Pat. Off. ..... 82200182.2

[51] Int. Cl.[3] ..... A62B 1/12

[52] U.S. Cl. ..... 182/238; 182/233; 242/96; 242/99; 254/377

[58] Field of Search ..... 242/99, 107.3; 254/267, 254/375, 376, 377; 182/73, 75, 236–238, 291, 233

[56] References Cited

U.S. PATENT DOCUMENTS

| | | | |
|---|---|---|---|
| 3,861,496 | 1/1975 | Hoover | 182/73 |
| 3,879,016 | 4/1975 | Kankkunen | 242/99 |
| 3,907,256 | 9/1975 | Kankkunen | 242/107.3 |
| 4,018,423 | 4/1977 | Belew | 182/291 X |

FOREIGN PATENT DOCUMENTS

| | | |
|---|---|---|
| 8002506 | 12/1981 | Netherlands . |
| 8006056 | 12/1981 | Netherlands . |

*Primary Examiner*—Leonard D. Christian
*Attorney, Agent, or Firm*—Diller, Ramik & Wight

[57] ABSTRACT

A reel for a life-line comprising a frame, a winding member rotatably journalled in said frame and damping means connected on the one hand with the frame and on the other hand with the winding member for counteracting the rotation of the winding member, said damping means comprising at least two piston pumps axially arranged side by side in a pump housing and cam discs, the cylinder chambers of said piston pumps communicating with one another by an axial channel forming a restriction and the pistons being in contact with the surfaces of the cam discs relatively off-set by half a cam interval, said winding member extending around the damping means, said cam discs being formed by rings and each piston pump being radially arranged inside a ring, while the axial channel is in line with a bore extending from a head face of the pump housing.

6 Claims, 3 Drawing Figures

FIG.1
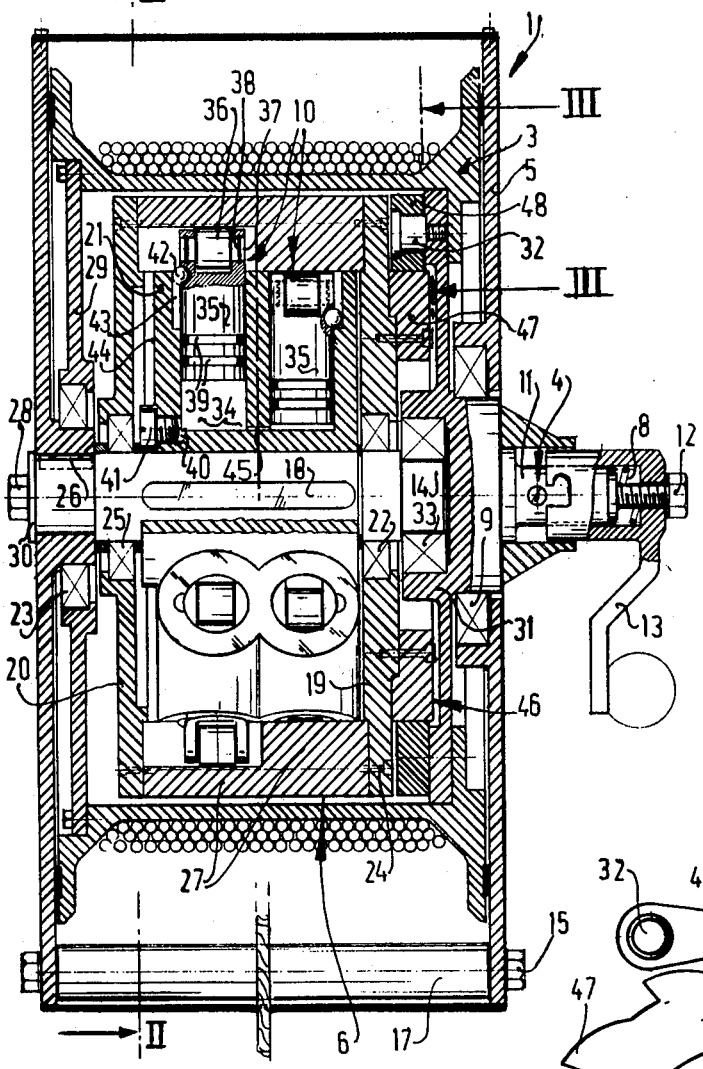
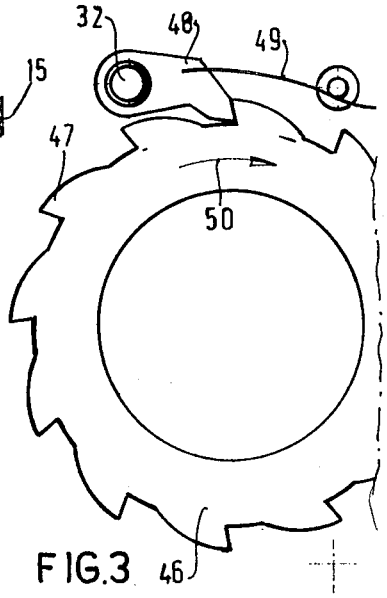
FIG.3

REEL FOR A LIFE-LINE

The invention relates to a reel for a life-line comprising a frame, a winding member rotatably journalled in said frame and damping means connected on the one hand with the frame and on the other hand with the winding member for counteracting the rotation of the winding member, said damping means comprising at least two piston pumps axially arranged side by side in a pump housing and cam discs, the cylinder rooms of said piston pumps communicating with one another by an axial channel forming a restriction and the pistons being in contact with the surfaces of the cam discs relatively off-set by half a cam interval.

Such a reel may be employed for leaving a building along the outside in an emergency case. The reel as a whole is suspended at a suitable place. By sitting down in a loop connected with the life-line or forming part thereof a person can descend with a quiet speed to the ground, since the reel quietly winds off as a result of the damping effect of the damping means.

A reel of the kind set forth is known from published Dutch patent application No. 8002506 filed Apr. 29, 1980. The winding member is coupled through a ratchet pawl with cam discs arranged in line with the shaft of the winding member and hence at the side of the winding member. The piston pumps are arranged in pump rings extending around the cam discs and mounted in contact with one another. The communication channels alternately extend partly in one ring and partly in the other. Consequently this known reel has, apart from the vulnerable place of the damping means on the outside of the reel, the disadvantage of being manufactured only with difficulty. Accurate machining is required to provide the channel portions concerned, having a very small diameter, in the pump rings in a manner such that they are accurately in line. Even at a minor relative shift of the channel portions the flow resistance will strongly increase so that also the damping force produced by the associated piston pumps will appreciably increase. All this has the consequence that it is particularly difficult to manufacture reels which all have an at least substantially equal damping effect. In order to mitigate this problem in the known reel provisions are made to make the damping adjustable. This is achieved by relatively turning the pump rings so that the flow resistance in the communicating channels is varied. This adjustability adds to the vulnerability of the known reel.

The present invention has for its object to provide a reel of the kind set forth in the preamble, which is simpler and less vulnerable. In a reel according to the invention this is achieved by arranging the winding member around the damping means, by using cam discs in the form of rings and by arranging each piston pump radially inside a ring, whilst the axial channel is in line with a bore extending from a head face of the pump housing. The damping means are enclosed herein in the winding member and are thus protected against mechanical damage. The communicating channels can be simply drilled in one run on a bench. The angular position of the axial bores is relatively unimportant so that no great accuracy need be observed for the location of these bores. As long as the bore interconnects the two different cylinder rooms, any place of the bore will satisfy.

From Dutch patent application No. 8006056 is known a reel which is little susceptible to be mechanically damaged because the winding member is arranged around the damping means. However, this reel too can be manufactured only with difficulty, since the communicating channels extend radially towards a central channel so that drilling these communicating channels takes much time. Moreover, this reel is not of the kind to which the invention relates. In this reel all pumps are communicating with one another. This means that filling the pumps with damping oil has to be very carefully carried out and, moreover, that the state of fill has to be regularly checked because in the event of a single small leak none of the pumps can any longer have a damping effect. Consequently said known reel is not very suitable to operate as a life-saving means because in this case the reel may remain unused and unchecked for a very long time. The reel of the kind to which this invention relates, on the contrary, is quite suitable for such use, since even in the event of leakage at the most one pair of pumps is thrown out of operation whereas the damping effect of the remaining pumps is maintained.

In the construction of the reel embodying the invention it is not possible to use a large number of pumps in an axial direction. Consequently the available pumps have to absorb strong forces. To this end, in a preferred embodiment of the reel according to the invention the pistons are provided at their ends facing the cam ring with a cam roller.

When in accordance with the invention the flanks of the cams have a profile such that the tangential line at each point is at a fixed angle to the radius going through the tangential point, a depression rate of the pistons is obtained which is proportional to the angular rate of the winding member. At a uniform speed of revolution of the winding member damping oil is thus displaced in the pumps with constant velocity so that a constant, viscous damping is achieved. This very advantageously contributes to a quiet operation of the reel.

Further advantages and features of the invention will become apparent from the following description of an embodiment of the invention shown in the figures.

FIG. 1 is a longitudinal sectional view of an embodiment of the reel in accordance with the invention.

FIG. 3 is a partial sectional view taken on the line III—III in FIG. 1.

Figure 2:
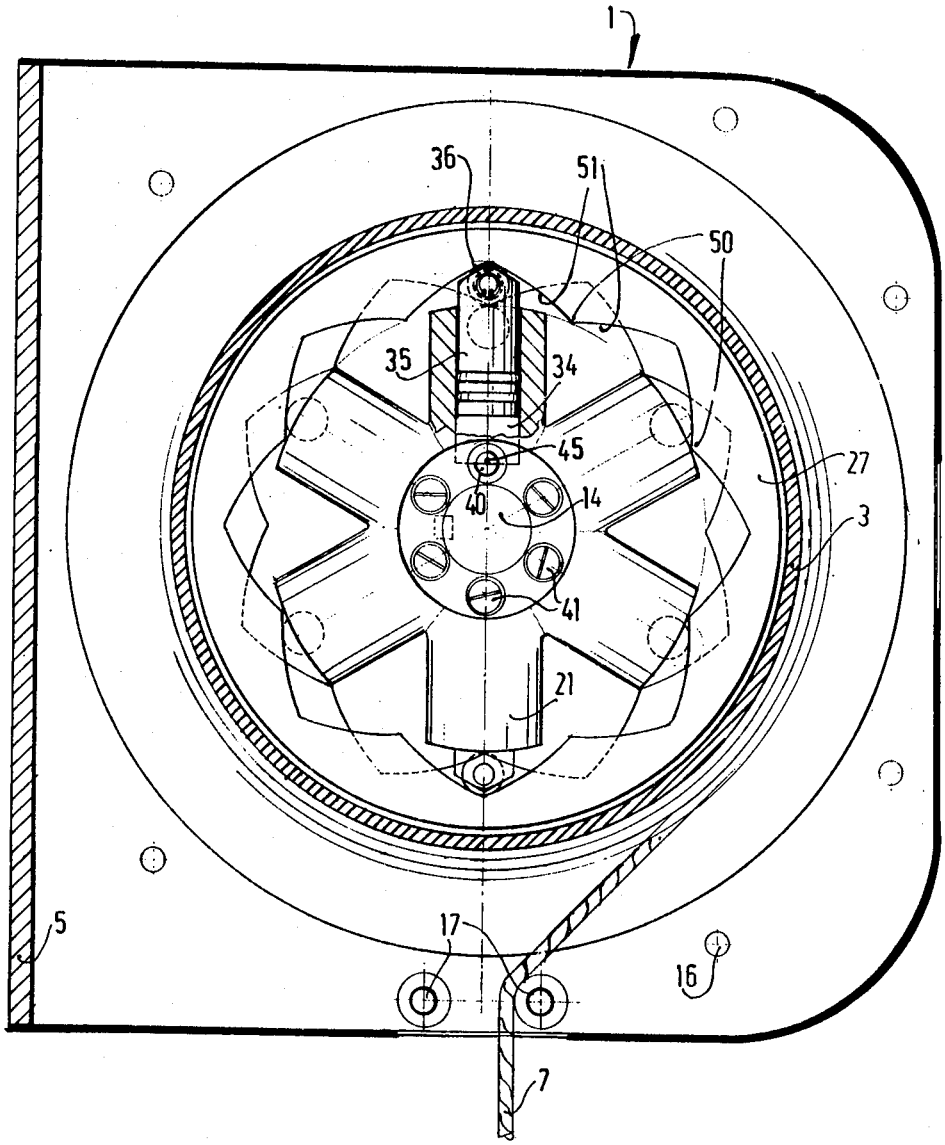
FIG. 2 is a sectional view taken on the line II—II in FIG. 1.

The reel 1 comprises a frame 5, in which a winding member 3 for a life-line 7 is rotatably journalled. Inside the winding member damping means 6 are connected on the one hand with the winding member 3 and on the other hand with the frame 5 in a manner such that they can counteract the unwinding movement of the winding member 3.

The damping means 6 are basically formed by pairs of piston pumps 10 arranged in a pump housing 21, which is non-rotatably connected with the frame 5. The piston pumps 10 co-operate with cam rings 27, which can rotate with the winding member 3.

The cam rings 27, which are relatively off-set by half a cam interval as is shown in FIG. 2, are fastened by means of bolts 24 shown schematically to head plates 19 and 20. The head plates 19 and 20 are journalled by bearings 22 and 25 respectively on a shaft 14. The shaft 14 is non-rotatably connected with the frame 5 with the aid of a wedge 26 and blocked in the axial direction by means of a bolt 28 and a ring 30 with respect to the frame 5. The pump housing 21 is rigidly secured to the shaft 14 by means of a wedge 18.

The winding member 3 comprises head plates 29 and 31. The head plate 29 is journalled by means of a bearing 23 and the head plate 31 by means of a bearing 9 in frame 5. On the inner side the head plate 31 has a further bearing 33 for satisfactorily centering the shaft 14.

The head plate 31 comprises a stub shaft 11 protruding out of frame 5. A handle 13 is axially displaceable on the stub shaft 11. The distance of the axial movement of the handle 13 is limited by a bolt 12. A spring 8 normally urges the handle 13 towards the outside. By pressing in the handle 13 against the force of the spring 8 a coupling 4 becomes operative by connecting the handle 13 towards the outside. By pressing in the handle 13 against the force of the spring 8 a coupling 4 becomes operative by connecting the handle 13 with the winding member 3. The handle 13 serves to wind up the life-line 7 after unwinding. The coupling 4 ensures that the handle 13 cannot hinder winding-off of the life-line. When the handle 13 is retained in the discoupled state, the life-line 7 can nevertheless wind off unhindered.

Between the winding member 3 and the cam member formed by the cam rings 27 together with the head plates 19 and 20 is arranged an overrunning clutch 46. This overrunning clutch 46 comprises a pawl wheel 47 rigidly secured to the cam member and a plurality of pawls 48 connected with the end plate 31 of the winding member 3. The pawls 48 can turn about bearing pins 32 and are urged by a leaf spring 49 in a sense to engage the pawl wheel 46.

From the figures it will be apparent that the winding-off direction of the winding member 3 corresponds with the direction indicated in FIG. 3 by the arrow 50. In this winding-off direction the winding member 3 will carry along the pawl wheel 47 through the bearing pin 32 and the pawl 48. Consequently, in the winding-off direction of the life-line 7 the cam member is coupled with the winding member. In the opposite direction, that is to say, the winding-up direction of the winding member 3 the overrunning clutch 46 is freely running. The life-line 7 can thus be readily wound up without being hindered by the damping means by turning the winding member 3 with the aid of the handle 13.

In order to guide the life-line 7 rollers 17 are arranged in the frame and fastened by means of bolts 15. The flanges of the frame 5 are furthermore interconnected by means of a plurality of spacer elements represented in FIG. 2 by the bolt holes 16.

In the embodiment shown of the reel 1 the pump body 21 comprises six pairs of piston pumps 10. Each piston pump 10 has a cylinder 34 accommodating a piston 35. At the end protruding out of the cylinder 34 each piston 35 carries a cam roller 36 being in contact with the cam profile of cam ring 27 concerned. The cam roller 36 is journalled by means of a shaft 37 in the piston 35. The shaft 37 is locked by means of guard rings 38. In order to prevent the piston 35 from turning about its longitudinal axis as a result of which the roller 36 would no longer correctly come into contact with the cam face, a guard ball 42 is provided, said ball engaging the piston 35 and being displaceable in a fitting groove 43 in the wall of the cylinder 34.

As stated above, the cam rings 27 are relatively offset by half a cam interval. As a result the pistons 35 of two neighbouring piston pumps 10 move in opposite senses. Between the associated cylinders 34 a channel 45 is provided, through which oil is pressed in reciprocatory manner upon rotation of the cam member with respect to the pump housing 21. The flow resistance thus experienced by the oil produces the damping effect.

FIGS. 1 and 2 show that the axial channel 45 is in line with a bore 40 in the head face 44 of the pump housing 21. The bore 40 is tapped for receiving a sealing screw 41. The pistons 35 are sealed in the cylinders 34 by means of stuffing rings 39.

FIG. 2 clearly shows that the bores 40 and the channels 45 can be simply milled in a single clamping of the pump housing on a bench. The place of the channel 45 is not critical, if only the two neighbouring cylinder spaces 34 are put into communication with one another. Thus the manufacture of the pump housing becomes very simple.

It will furthermore be apparent from FIG. 2 that the flanks 51 of the cams 50 have a profile such that the tangential line at each point is at a fixed angle to the radius going from the centre line of the shaft 15 through the tangential point. Therefore the radial distance from the centre line between two points on a flank 51 is proportional to the angular distance between said two points. Consequently the rate of radial movement of a piston 35 is constantly linearly dependent on the relative angular speed. Since the viscous damping is linearly dependent on the flow rate of the viscous medium, in this case the damping oil, the viscous damping force in this embodiment of the reel according to the invention is linearly dependent on the winding-off rate of the member 3.

Although the invention is described with reference to a reel for a life-line by which persons can leave a building along the outer side, the invention is not limited to such a reel. The reel according to the invention is also particularly suitable for safely lowering a life-boat. Since the line on the winding member of the reel quietly winds off fully automatically without any manipulation from the outside, a safe lowering of a life-boat by means of said reel is no longer dependent on the sang-froid of the operator in an emergency case.

What is claimed is:

1. A reel for a life-line, a frame adapted to be secured to a support, a winding member rotatably supported by said frame about a fixed axis and capable of paying out a life-line as the winding member rotates about said axis, damping means acting between said frame and said winding member for controlling the rotational speed of the latter, said frame including a housing portion having a side-by-side pair of cylinder bores extending outwardly with respect to said axis to present blind inner ends and open outer ends, said bores being spaced apart to present a wall therebetween, piston means reciprocable in each bore, cam means rotatable with said winding member and surrounding said housing portion for urging one piston means inwardly into its bore while permitting the other piston means to be expelled outwardly into contact with said cam means, and a channel in said housing portion extending unidirectionally through that region of said wall of the housing portion separating said blind inner ends of said bores so as to establish direct communication therebetween, said channel being of a predetermined cross sectional area to provide selected resistance to the flow of fluid pumped back and forth between those volumes of the bores beneath said piston means.

2. A reel for life-lines as defined in claim 1 wherein each piston means includes a roller contacting said cam means.

3. A reel for life-lines as defined in claim 2 wherein said cam means comprises a cam ring for each roller and with which each roller provides line contact with its cam ring, each cam ring having a series of cam lobes the flanks of which are formed such that the tangent to the line contact is at a fixed angle relative to the axis of the corresponding bore throughout the extents of said flanks whereby the rates of movements of the piston means are linearly related to the angular velocity of said winding means.

4. A reel for a life-line, a frame adapted to be secured to a support and including a pump housing portion, cam means rotatably mounted on said frame about a horizontal axis and in surrounding relation to said pump housing portion, said pump housing portion including a pair of side-by-side cylinder bores which lie on parallel axes in a plane which contains and extends radially from said horizontal axis, said bores terminating in blind inner ends located radially outwardly of said horizontal axis and extending to open ends located radially inwardly of said cam means, a piston means in each bore for defining a fluid space between it and the inner end of the corresponding cylinder bore, said cam means engaging said piston means for urging one piston means inwardly of its bore to decrease the volume of its fluid space while the other piston means is allowed to increase the volume of its fluid space, and a fluid interconnection channel in said pump housing portion which extends unidirectionally, parallel to said axis and close to said inner ends of the bore, into said pump housing portion and in intersecting relation to both of said bores to form a direct, restricted fluid communication between said bores substantially at said inner ends thereof.

5. A reel for life-lines as defined in claim 4 wherein each piston means includes a roller contacting said cam means.

6. A reel for life-lines as defined in claim 5 wherein said cam means comprises a cam ring for each roller and with which each roller provides line contact with its cam ring, each cam ring having a series of cam lobes the flanks of which are formed such that the tangent to the line contact is at a fixed angle relative to the axis of the corresponding bore throughout the extents of said flanks whereby the rates of movements of the piston means are linearly related to the angular velocity of said winding means.

* * * * *